US005183015A

United States Patent [19]

Morita et al.

[11] Patent Number: 5,183,015

[45] Date of Patent: Feb. 2, 1993

[54] VALVE OPERATING APPARATUS

[75] Inventors: Shoji Morita; Yoshihiko Yamada; Seinosuke Hara, all of Kanagawa, Japan

[73] Assignee: Atsugi Unisia Corporation, Kanagawa, Japan

[21] Appl. No.: 873,362

[22] Filed: Apr. 24, 1992

[30] Foreign Application Priority Data

Apr. 26, 1991 [JP] Japan ..... 3-097238

[51] Int. Cl.[5] ..... F01L 1/34

[52] U.S. Cl. ..... 123/90.16; 123/90.39

[58] Field of Search ..... 123/90.15, 90.16, 90.22, 123/90.39, 90.4, 90.41, 90.44

[56] References Cited

U.S. PATENT DOCUMENTS 4,612,884 9/1986 Ajiki et al. ..... 123/90.16
4,768,467 9/1988 Yamada et al. ..... 123/90.16
5,020,488 6/1991 Watanabe ..... 123/90.16
5,042,437 8/1991 Sakuragi et al. ..... 123/90.16
5,046,462 9/1991 Matayoshi et al. ..... 123/90.16
5,080,054 1/1992 Nakamura ..... 123/90.16
5,085,182 2/1992 Nakamura et al. ..... 123/90.16

FOREIGN PATENT DOCUMENTS 63-57806 3/1988 Japan .
63-167016 7/1988 Japan .

*Primary Examiner*—E. Rollins Cross
*Assistant Examiner*—Weilun Lo
*Attorney, Agent, or Firm*—Bachman & LaPointe

[57] ABSTRACT

A valve operating apparatus for an engine is disclosed. The apparatus includes a rocker arm operated by a first cam and a free cam follower operated by a second cam. The rocker arm has an integral barrel having a lost motion mechanism. A prop is slidably received by the free cam follower for movement between a first position in which the prop supports the free cam follower on the lost motion mechanism and a second position in which the prop supports the free cam follower on the barrel. A hydraulically operated piston moves the prop.

6 Claims, 6 Drawing Sheets

VALVE OPERATING APPARATUS

BACKGROUND OF THE INVENTION

The present invention relates to a valve operating apparatus for an engine.

Japanese Patent Application First (unexamined) Publications Nos. 63-57806 and 63-167016 disclose a valve operating apparatus. The known valve operating apparatus comprises a mechanism to releasably interconnect the adjacent two cam operated rocker arms. The rocker arms are formed with mating bores receiving a plunger. The plunger is movable between a first position in which the plunger is disposed in one of the mating bores and a second position in which the plunger is inserted into the other plunger and thus disposed in both of the mating bores. When the plunger is in the first position, the two rocker arms move separately, while when the plunger is in the second position, they moves as a unit.

This mechanism using the plunger and mating bores, however, requires high degree of precision in forming the mating bores and the plunger.

An object of the present invention is to provide a valve operating apparatus which does not use a plunger and bores which demand high degree of precision to form.

SUMMARY OF THE INVENTION

According to the present invention, there is provided an apparatus for operating a valve, comprising:

a first cam;

a second cam;

a rocker arm for the valve and operated by said first cam, said rocker arm having a predetermined part having a lost motion mechanism;

a free cam follower pivoted to said rocker arm and operated by said second cam;

a prop slidably received by said free cam follower for movement between a first position in which said prop supports said free cam follower on said lost motion mechanism and a second position in which said prop supports said free cam follower on said predetermined part; and means adapted for shifting said prop between said first and second position.

DETAILED DESCRIPTION OF THE INVENTION

Figure 1:
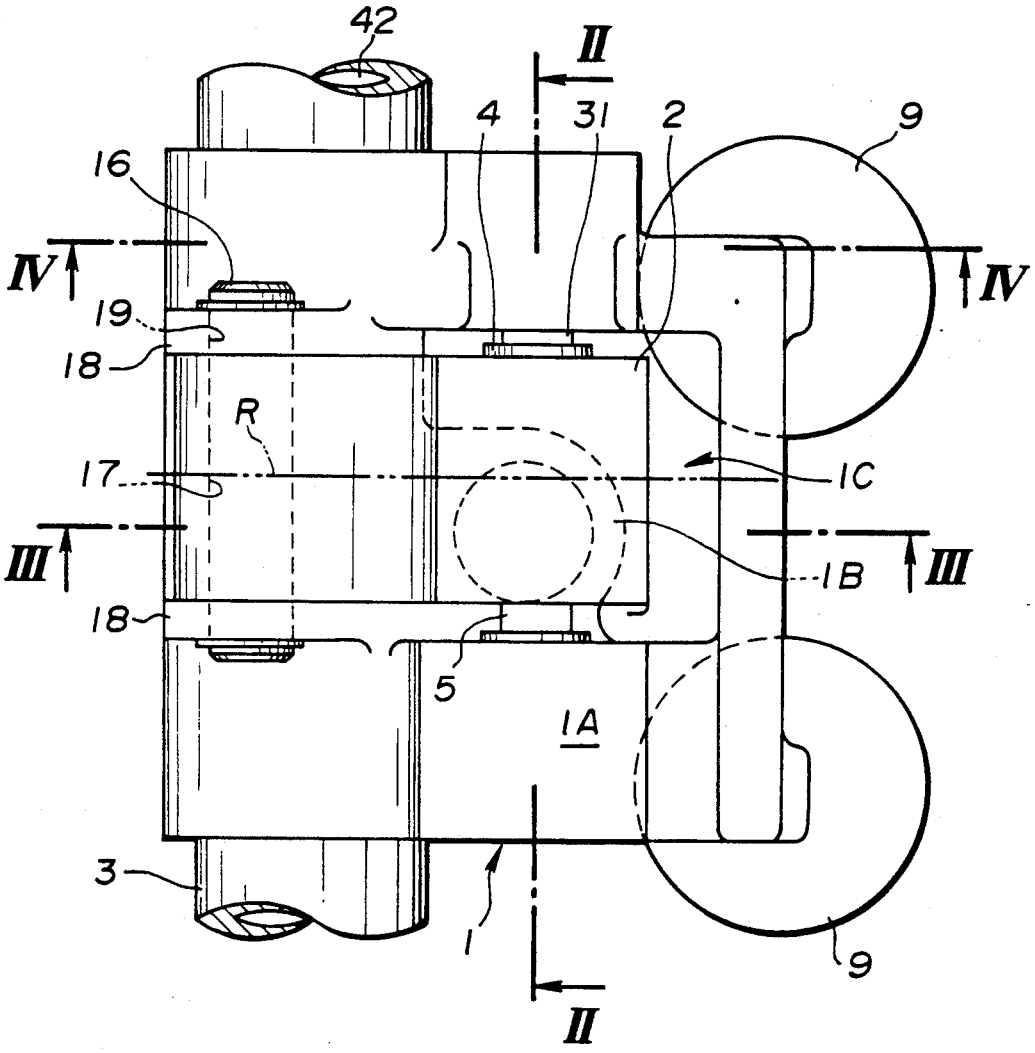
FIG. 1 is a plan view of a first embodiment of an apparatus according to the present invention.
Figure 4:
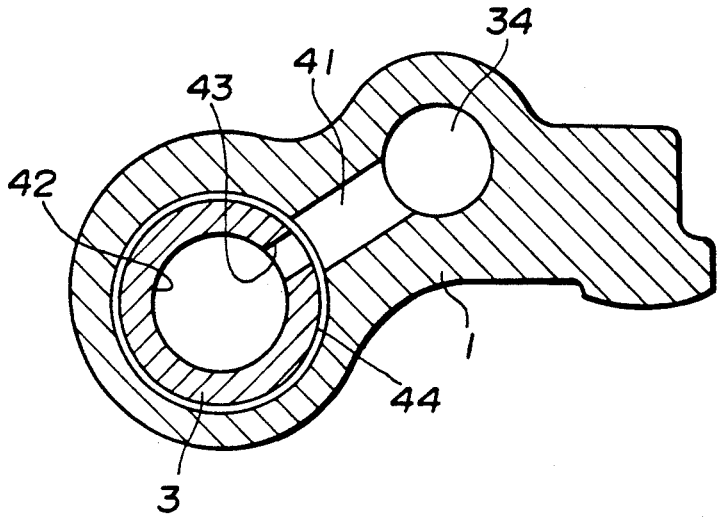
FIG. 4 is a section taken through the line IV—IV in FIG. 1.

Referring to the accompanying drawings, FIGS. 1 and 4 show a first embodiment according to the present invention. In FIG. 1, the invention is embodied with an engine having per cylinder two valves with the same function, e.g., two intake valves or two exhaust valves.

In FIG. 1, there is shown a valve operating apparatus with two poppet type intake valves 9 which are provided for each of cylinders of an internal combustion engine. Two valves 9 per cylinder are operated by a single rocker arm 1 which is pivoted to a rocker shaft 3 mounted to a cylinder head of the engine. As is readily seen from FIGS. 1 and 3, the rocker arm 1 has two protruding portions which are in abutting engagement with stems of the intake valves 9, respectively.

Figure 2:
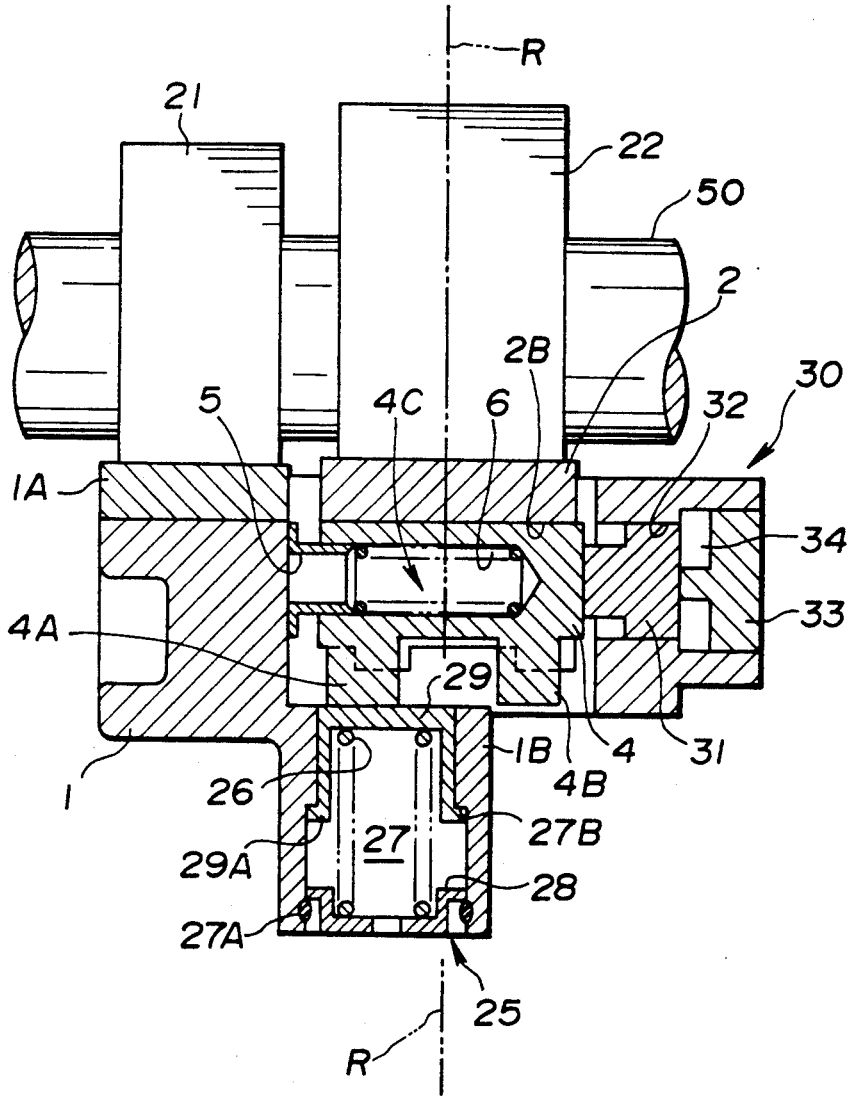
FIG. 2 is a section taken through the line II—II in FIG. 1.

The rocker arm 1 has a free cam follower 2. Fixedly attached to a portion disposed on the lefthand side of the free cam follower 2, as viewed in FIG. 2, is a cam follower 1A in slidable engagement with a first or low speed cam 21. On the righthand side of the free cam follower 2 is a portion of the rocker arm 1 which is set aside for a hydraulic drive module. The free cam follower 2 is pivoted to a shaft 16 mounted to the rocker arm 1. The shaft 16 is slidably received in a bore 17 formed through the free cam follower 2 and has its ends received in press fit manner in bores 19 formed in the rocker arm 1.

Figure 3:
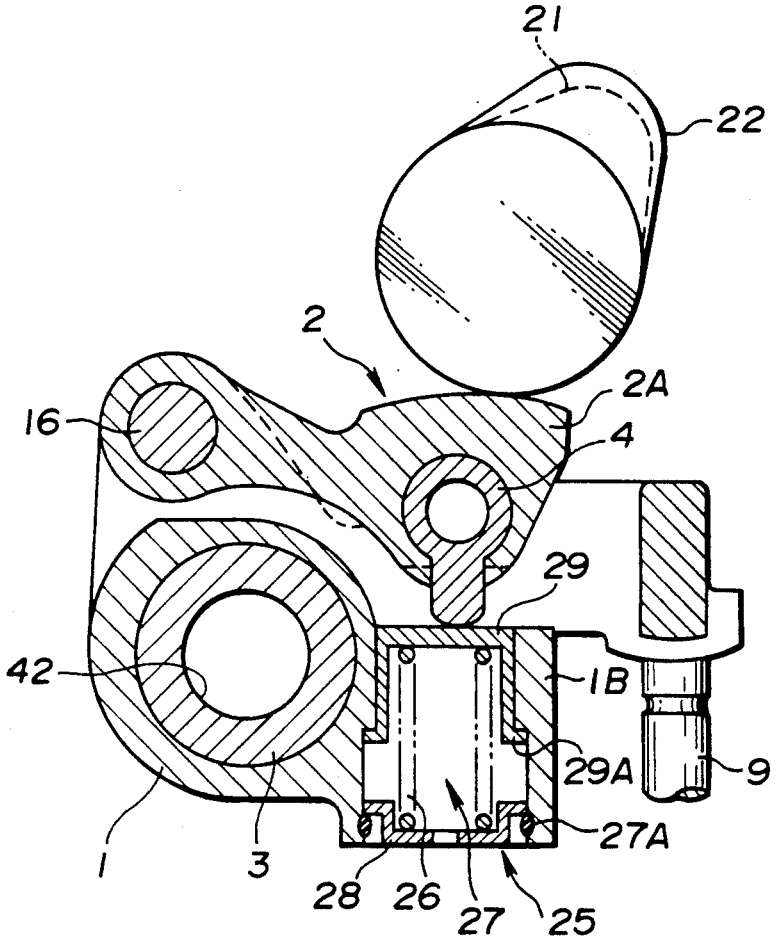
FIG. 3 is a section taken through the line III—III in FIG. 1.

The free cam follower 2 is not provided with any portion in abutting engagement with the intake valves 9. As best seen in FIG. 3, the free cam follower 2 has a projecting arm formed with a cylindrical cam follower 2A kept in slidable contact with a second or high speed cam 22.

Defined between the two protruding arms of the rocker arm 1 is a space 1C receiving the free cam follower 2. This space 1C is defined by two mutually facing wals which are spaced from each other along the axis of the rocker shaft 3. As best seen in FIG. 2, the rocker arm 1 has an integral barrel 1B which has a top wall extending from one of the two mutually facing walls toward but in a spaced relationship with the other. This barrel 1B is formed with a stepped cylindrical through bore 27 including an annular shoulder 27B.

A lost motion mechanism 25 is received in the stepped cylindrical bore 27. The lost motion mechanism 25 includes a lost motion spring 26 having one end bearing against an end plug 28 fixed relative to the cylindrical bore 27 by means of a stop ring 27A and an opposite end bearing against a reciprocal cap 29. The cap 29 has a flat top and a bottom flange 29A. In a spring set position as illustrated in FIG. 2, the cap 29 does not project out of the bore 27 owing to the bottom flange 29A engaged by the annular shoulder 27B. In this embodiment, the flat top of the cap 29 is kept as high as the top wall of the barrel 1B surrounding the edge of the bore 27. Upon subject to a force, the spring 26 is compressed to allow inward movement of the cap 29. The setting is such that the spring 26 is weak enough to allow reciprocal motion of the cap 29 without any great thrust on the rocker arm 1 via the end plug 28.

Referring to FIG. 3, a prop 4 is received in a key groove type through bore 2B formed through the free cam follower 2. This through bore 2B extends in a parallel relationship with the shaft 16. As readily seen from FIG. 3, the cam follower 2A is kept in slidable engagement with the high speed cam 22 owing to the action of the spring 26, the cap 29 and the prop 4. On other hand, the cam follower 1A of the rocker arm 1 is kept in slidable engagement with the low speed cam 21 owing to return springs, not shown, of the intake valves 9.

Figure 6:
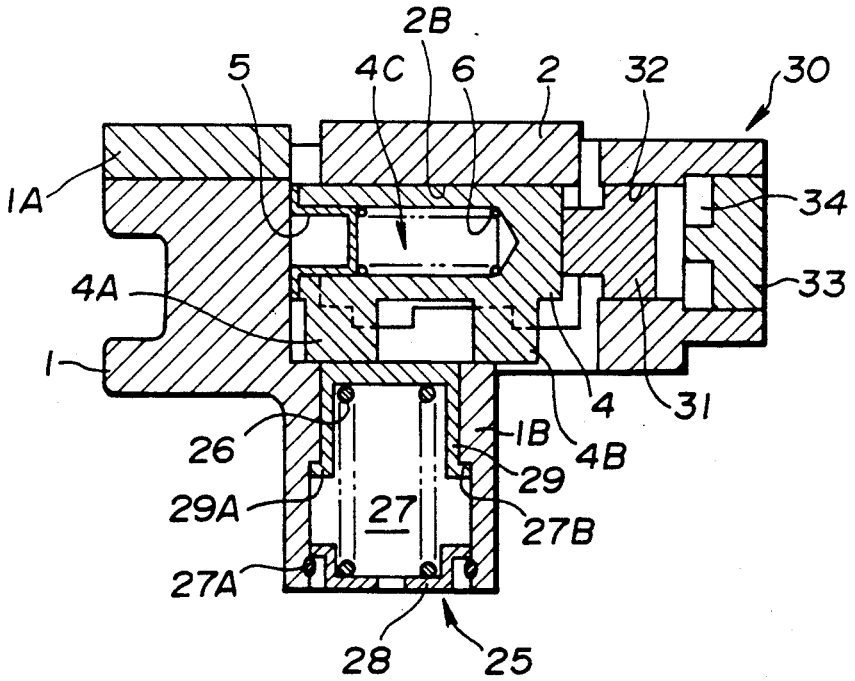
FIG. 6 is a similar view to FIG. 2 showing the apparatus in a different position.

Referring to FIGS. 2 and 6, the prop 4 has a first position as illustrated in FIG. 2 in which the prop 4 does not support the free cam follower 2 on the rocker arm 1 but on the lost motion mechanism 25, rendering the lost motion mechanism 25 operative to allow independent motion of the free cam follower 2 from the rocker arm 1, and a second position as illustrated in FIG. 6 in which the prop support the free cam follower 2 on the barrel 1B, permitting the free cam follower 2 to drive the rocker arm 1.

The prop 4 includes a cylindrical portion formed with a bore 4C and radially extending first and second legs 4A and 4B. The bore 4C has one end closed by an axial end of the cylindrical portion of the prop 4 and an opposite end open. A cylindrical guide 5 is slidably inserted into the bore 4C from the open end thereof and held in slidable engagement with the adjacent one of the walls defining the opening 1C owing to the action of a return spring 6 disposed in the bore 4C. The return spring acts between the guide 5 and the closed end of the bore 4C to push back the prop 4 from the second position (FIG. 6) to the first position (FIG. 2).

As viewed in FIG. 2, in abutting engagement with the axial closed end of the prop 4 is a hydraulic piston 31 of a hydraulic actuator 30. The piston 31 is slidably received in a stepped cylindrical through bore 32 formed through one of the protruding portions of the rocker arm 1. The stepped through bore 32 has a reduced diameter section adjacent to the space 1C. The piston 31 is received by this reduced diameter bore section. A plug 33 closes the remote end of the through bore 32 from the space 1C. The plug 33 has a central projection that limits movement of the piston 31, thus defining the first position of the prop 4 as illustrated in FIG. 2. Defined within the through bore 32 between the piston 31 and the plug 33 is a hydraulic pressure chamber 34.

As best seen in FIG. 4, the rocker arm 1 is formed with a through hole 41 which extends from a cylindrical bearing surface for the rocker shaft 3 to the hydraulic pressure chamber 34. The rocker shaft 3 is formed with an axially extending oil gallery 42, a radial port 43 and a circumferential groove 44. Flow communication between the gallery 42 and the hole 41 is established by the radial port 43 and the circumferential groove 44.

Supplied to the oil gallery 42 is a hydraulic fluid under pressure discharged by an oil pump. Supply of hydraulic fluid to and discharge thereof from the oil gallery 42 is controlled by a two-position shift valve operated by a solenoid that is energized in response to an output signal of a control unit. The shift valve has a first position wherein the hydraulic fluid is discharged from the oil gallery 42 and the hydraulic pressure chamber 34 and a second position wherein the hydraulic fluid is supplied to the oil gallery 42 and the hydraulic pressure chamber 34. Thus, the hydraulic pressure changes from a low level to a high level owing to this shift. Supplied to the control unit are an engine speed signal, an engine coolant temperature signal, an oil temperature signal, a signal indicative of charging owing to operation of a turbo charger, a throttle valve position signal, and etc. The control strategy followed by the control unit is such that the hydraulic fluid is supplied to the hydraulic pressure chamber 34 during high speed engine operation so as to render the high speed cam 22 to operate the valves 9.

As best seen in FIG. 2, the low speed cam 21 and the adjacent high speed cam 22 are integral with a common cam shaft 50. These cams 21 and 22 are so shaped to have profiles to meet different demands during low speed operation and during high speed operation. Specifically, at least one of a valve lift and a valve opening period provided by the profile of the high speed cam 22 is greater than the corresponding one of a valve lift and a valve opening period provided by the profile of the low speed cam 21. In this embodiment, the high speed cam 22 provides a valve lift and a valve opening period which are greater than their counterparts of the low speed cam 21.

Figure 5:
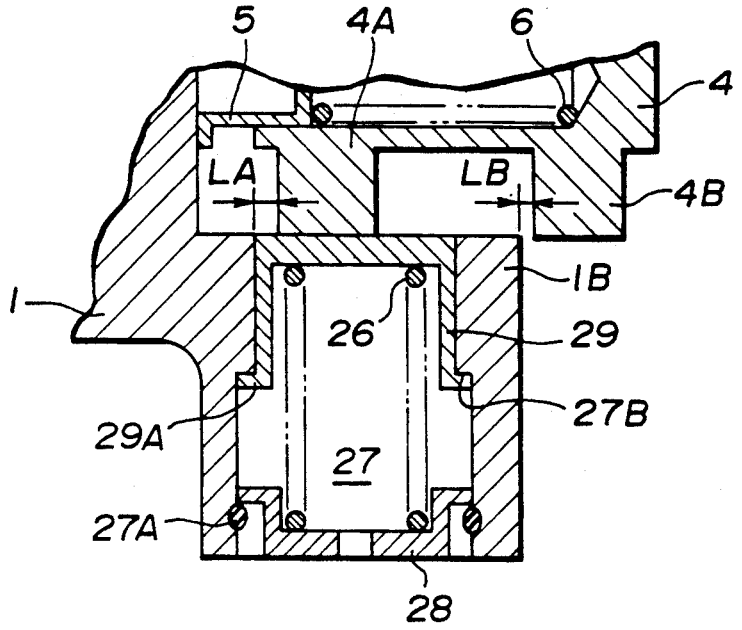
FIG. 5 is an enlarged fragmentary view of FIG. 2.

FIG. 5 shows the relationship of the two legs 4A and 4B of the prop 4 with respect to the barrel 1B of the rocker arm 1. The relationship is such that during a shift from the position illustrated in FIG. 5 to the position illustrated in FIG. 6, a distance LB through which the leading edge of the second leg 4B travels until it rides on the top wall of the barrel 1B is less than a distance LA through which the leading edge of the first leg 4A travels until it rides on the top wall of the barrel 1B.

With respect to an imaginary radial plane R bisecting the free cam follower 2, that wall section of the barrel 1B which is adapted to be engaged by the second leg 4B is disposed near the radial plane R and distant less than that wall section of the barrel 1B which is adapted to be engaged by the first leg 4A. This arrangement prevents undesired tilting of the free cam follower 2 which otherwise might occur during a shift of the prop 4 from the position illustrated in FIG. 2 to the position illustrated in FIG. 6.

During operation of the engine at low speeds, the apparatus takes the position as illustrated in FIG. 2. In this position, the motion of the rocker arm 1 follows the profile of the low speed cam 21 since the motion of free cam follower 2 due to the high speed cam 22 is received by stroke of the cap 29 of the lost motion mechanism 25 and thus does not interfere with the motion of the rocker arm 1.

During operation of the engine at high speeds, the apparatus takes the position as illustrated in FIG. 6 since the piston 31 keeps the prop 4 in the position illustrated in FIG. 6 owing to a pressure build-up in the chamber 34. In this position, the free cam follower 2 now stands on the barrel 1B of the rocker arm 1 and thus the free cam follower 2 transmits its motion to the rocker arm 1. When the rocker arm 1 swings, the cam follower 1A is disengaged from the low speed cam 21 since the high speed cam 22 has a high valve lift characteristic.

For a shift from the position illustrated in FIG. 2 to the position illustrated in FIG. 6, the supply of hydraulic fluid to the chamber 34 begins, cusing an increase in pressure in the chamber 34. The increase in pressure in the chamber 34 causes the piston 31 to move the prop 4 to the left as viewed in FIG. 5 against the action of the spring 6. During this leftward movement of the prop 4, the second leg 4B rides on the top wall of the barrel 1B and then the first leg 4A rides on the top wall of the barrel 1B. In the position as illustrated in FIG. 6, the first led portion 4A bridges the cap 29 of the lost motion mechanism 25 and the adjacent wall section of the barrel 1B.

For a shift from the position illustrated in FIG. 6 to the position illustrated in FIG. 2, the hydraulic fluid is discharged from the chamber 34 and has the spring 6 pushes the prop 4 and the piston 31 back to the position illustrated in FIG. 2.

With the arrangement as previously described in connection with FIG. 5, even if the pressure build-up in the chamber 34 is insufficient, the second leg 4B rides on the top wall the barrel 1B before the first leg 4A rides on the top wall of the barrel 1B. This is because that portion of the top wall of a barrel 1B which is engaged by the second leg 4B is located near the radial bisecting plane R. This arrangement thus effectively prevents occurrence of noise owing to tilting of the free cam follower 2.

Figure 7:
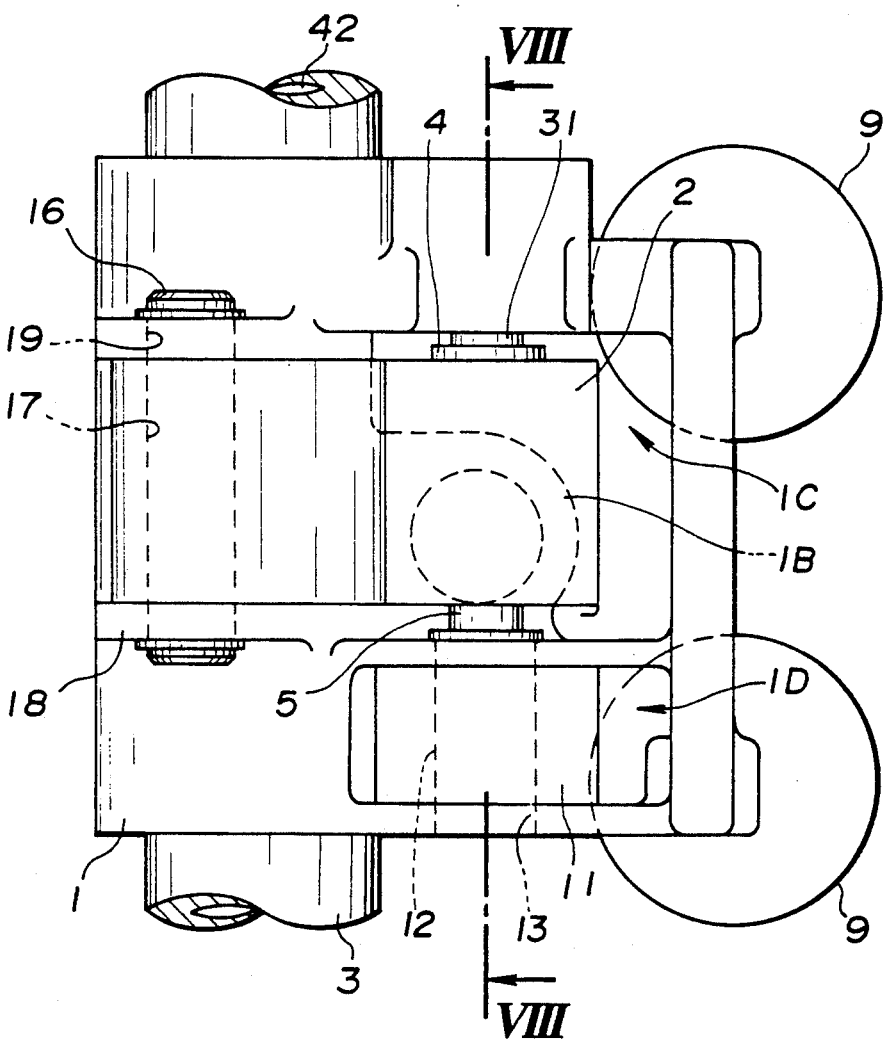
FIG. 7 is a similar view to FIG. 1 showing a second embodiment according to the present invention.
Figure 8:
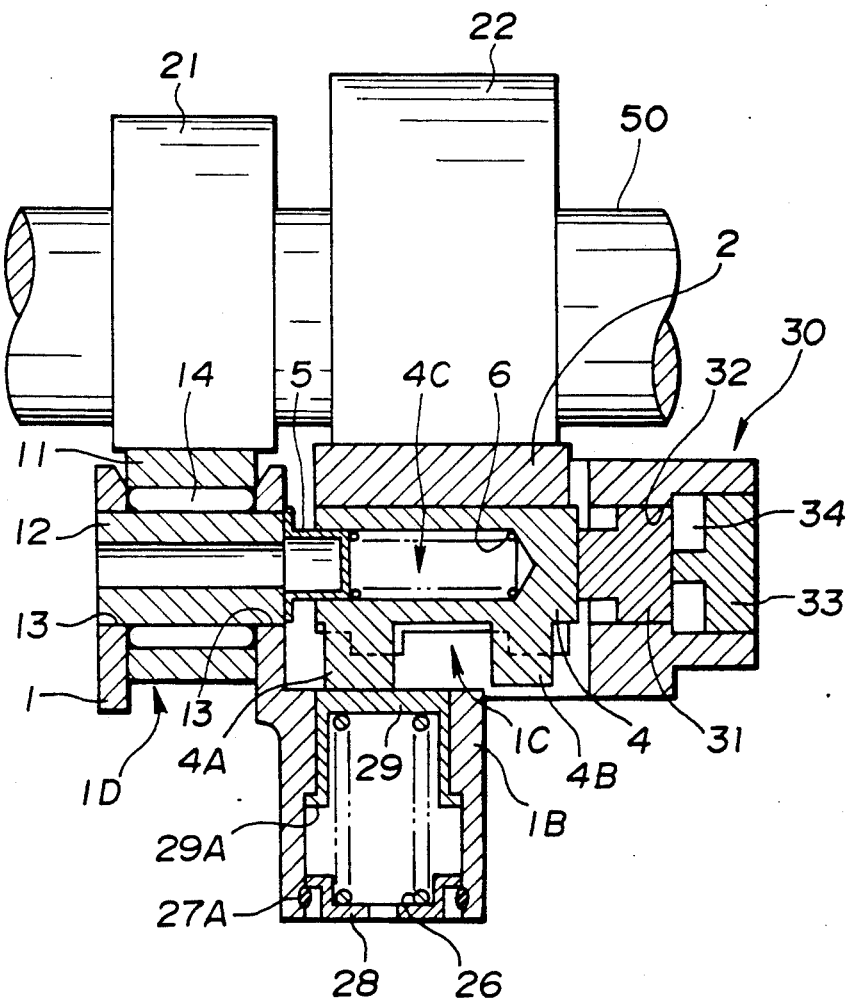
FIG. 8 is a similar view to FIG. 2 showing the second embodiment.

Referring to FIGS. 7 and 8, a second embodiment according to the present invention is explained.

This second embodiment is substantially the same as the first embodiment except the provision of a roller 11 in the place of the cam follower portion 1A. The provision of the roller 11 is advantageous for reduced friction with a low speed cam 21.

A rocker arm 1 is formed with a space 1D adjacent a space 1C as best seen in FIG. 7. The space 1D is provided for accommodating the roller 11. The roller 11 is rotatably supported via a needle bearing 14 by a hollow bearing shaft 12. The bearing shaft 12 has its ends extending through apertures 13 and fixed thereto.

In assembly, a pre-assembly including the roller 11 rotatably supported via the needle bearing on a vinyl tube (now shown) is mounted within the space 1D with the opposite ends of the vinyl tube received in the apertures 13. The bearing shaft 12 is inserted through the aperture 13 adjacent the space 1C, the space 1D and the other aperture 13 pushing the vinyl tube out of the space 1D. A tool is inserted axially through a bore 32 until it abuts the adjacent axial end of bearing shaft 12. Then, a force is applied to the other axial end of the bearing shaft 12 toward the tool until both axial ends are fixed relative to the adjacent apertures 13.

According to this second embodiment, the friction is reduced by the provision of the roller 11. In assembly, the vinyl tube is removed during insertion of the bearing shaft 12, making contribution to a reduction in production steps. Since the apertures 13 are axially aligbned with the through bore 32, the fixing work of the bearing shaft by caulking is conducted without applying any stress which causes deformation of the rocker arm 1.

What is claimed is:

1. An apparatus for operating a valve, comprising:

a first cam;

a second cam;

a rocker arm for the valve and operated by said first cam, said rocker arm having a predetermined part having a lost motion mechanism;

a free cam follower pivoted to said rocker arm and operated by said second cam;

a prop slidably received by said free cam follower for movement between a first position in which said prop supports said free cam follower on said lost motion mechanism and a second position in which said prop supports said free cam follower on said predetermined part; and means adapted for shifting said prop between said first and second position.

2. An apparatus as claimed in claim 1, wherein said predetermined part is in the form of a barrel with a wall.

3. An apparatus as claimed in claim 2, wherein said prop has a first leg and a second leg.

4. An apparatus as claimed in claim 3, wherein in said first position of said prop, said first leg rides on said lost motion mechanism and said second leg is out of engagement with said barrel.

5. An apparatus as claimed in claim 4, wherein in said second position of said prop, said first leg rides on said lost motion mechanism and the adjacent section of said wall of said barrel and said second leg rides on the adjacent section on said wall of said barrel.

6. An apparatus as claimed in claim 5, wherein during movement of said prop from said first position thereof to said second position thereof, said second leg rides on said wall of said barrel before said first leg rides on said wall of said barrel.

* * * * *